US006417472B1

(12) United States Patent
Kusserow et al.

(10) Patent No.: US 6,417,472 B1
(45) Date of Patent: Jul. 9, 2002

(54) VACUUM SWITCHING CHAMBER HAVING AN ANNULAR INSULATOR

(75) Inventors: Jörg Kusserow, Neuenhagen; Roman Renz; Klemens Fieberg, both of Berlin, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/600,801

(22) PCT Filed: Jan. 15, 1999

(86) PCT No.: PCT/DE99/00177

§ 371 (c)(1),
(2), (4) Date: Feb. 15, 2001

(87) PCT Pub. No.: WO99/38191

PCT Pub. Date: Jul. 29, 1999

(30) Foreign Application Priority Data

Jan. 21, 1998 (DE) ..... 198 02 893

(51) Int. Cl.[7] ..... H01H 33/66
(52) U.S. Cl. ..... 218/118; 218/135; 218/125
(58) Field of Search ..... 218/1, 2–7, 14, 218/43–50, 154, 111–120, 123–126, 127, 128, 134–137, 139, 140, 155

(56) References Cited

U.S. PATENT DOCUMENTS

| | | | | |
|---|---|---|---|---|
| 3,026,394 A | | 3/1962 | Jennings | |
| 4,310,735 A | * | 1/1982 | Sakuma et al. | 218/118 |
| 4,553,007 A | | 11/1985 | Wayland | |
| 4,614,850 A | * | 9/1986 | Kuhl et al. | 218/118 |
| 4,672,156 A | | 6/1987 | Basnett | |
| 5,763,848 A | * | 6/1998 | Hakamata et al. | 218/128 |
| 5,847,347 A | * | 12/1998 | Schwarze et al. | 218/139 |
| 6,005,213 A | * | 12/1999 | Morita et al. | 218/124 |

FOREIGN PATENT DOCUMENTS

| | | |
|---|---|---|
| DE | 27 00 761 | 7/1977 |
| DE | 29 44 286 | 5/1980 |
| DE | 44 22 316 | 12/1994 |
| DE | 44 01 356 | 7/1995 |
| DE | 37 09 585 | 3/1996 |
| DE | 195 10 850 | 7/1996 |
| DE | 196 24 920 | 1/1998 |
| EP | 0 200 465 | 11/1986 |
| EP | 0 532 513 | 3/1993 |

* cited by examiner

*Primary Examiner*—Lincoln Donovan
(74) *Attorney, Agent, or Firm*—Kenyon & Kenyon

(57) ABSTRACT

A vacuum switching chamber is provided for power switches in the low-voltage range, and has compact design and a high switching capacity. A housing of the switching chamber includes plate-type current terminals, a cylindrical wall part that surrounds flat spiral petal contacts, an annular insulator and a bellows arranged concentrically thereto. The current terminal bolt of the movable spiral petal contact is seated on the associated plate-type current terminal.

10 Claims, 2 Drawing Sheets

VACUUM SWITCHING CHAMBER HAVING AN ANNULAR INSULATOR

FIELD OF THE INVENTION

The present invention relates to the field of electrical components and is to be applied in the construction of vacuum switching chambers whose housings have two cap-type metal parts and an annular insulator, and which are accordingly provided for switching applications in the low-voltage range.

BACKGROUND INFORMATION

In a conventional vacuum switching chamber described in German Patent No. 44 22 216 the two cap-type metal parts made of copper, one of which forms the actual switching chamber for a stationary and for an axially movable contact piece, are each connected in vacuum-tight fashion with the annular insulator at the end of the tube-shaped wall area, using a cutting soldering. In order to enable reliable switching of short-circuit currents in the range of 50 to 100 kA with this conventional vacuum switching chamber at the smallest possible axial and radial dimensions, the one end of the bellows in the immediate vicinity of the movable contact piece is soldered to the contact bolt thereof, and is concentrically surrounded by the annular insulator. A cap-type protective plate on: the base of the movable contact piece protects the bellows against electrical loading. This switching tube has no special shielding for the protection of the inner insulation path formed by the annular insulator, since a relatively broad end surface of the annular insulator faces away from the contact region. As is standard, the current terminals of this conventional vacuum switching chamber are constructed as bolts that are led axially through the respective cap-type metal part. In addition, the two contact pieces are constructed as cup-shaped (hollow) contacts, although other conventional contact shapes, are also possible. Another conventional contact shape described in European Patent No. 0 532 513, is offered for example by what are called spiral petal contacts, having in particular flat plate-type contact electrodes that are provided with slots that run from the outer circumference toward the inside. These slots can be made up of a straight section and a bored hole that penetrates the contact surface.

As a switching element for low-volt contactors, conventional vacuum switching tubes as described in German Patent No. 37 09 585 which forms a part of the outer surface of the housing, and is here on the one hand soldered in vacuum-tight fashion with the current terminal of the movable contact bolt and on the other hand is soldered in vacuum-tight fashion at the end side with a short tube-shaped insulator German Patent No. 195 10 850 describes that the bellows can be connected both with the insulator and also with the current terminal of the movable contact bolt, using a cutting soldering.

In addition, U.S. Pat. No. 4,555,007 describes that in vacuum switching tubes for medium-voltage applications, it is conventional to provide the shield surrounding the switching path with an intermediate layer made of the same material (CrCu alloy) of which the contact electrodes are made. In addition, as described in German Patent No. 29 44 286, for parallel operation of direct-current electrolytic cells, some conventional vacuum switches, given a switching voltage of approximately 4 volts, have to switch a current of approximately 4000 A, and in which the cylindrical contacts are provided with planar conductive end plates, in order to enable an electrical connection of the switch with electrical terminal rails.

SUMMARY

An object of the present invention to further miniaturize the conventional vacuum switch chamber, at while same time increasing the switching capacity.

According to the present invention the current terminals of the two contact pieces are fashioned as plates that respectively form the base area of one of the two cap-type metal parts, also the bellows forms the wall area of the cap-type metal part that is allocated to the movable contact piece. Moreover a tube-shaped part, soldered at its end face with the plate-type current terminal of the stationary contact piece, forms the wall area of the other cap-type metal part.

Such a construction of the vacuum switching chamber leads to a flat construction, having a constructive length that is reduced significantly in comparison with conventional vacuum switching tubes. The construction of the current terminals in the form of plates, rather than the previously standard cylindrical bolts, contributes to this, these plates forming at the same time the end-face cover of the switching chamber, which in itself is cylindrical. The flat design of the new vacuum switching chamber can be even more clearly evident if the contact pieces are fashioned as spiral petal contacts, in particular as flat spiral petal contacts. In addition, the use of spiral petal contacts leads to better arc conducting, resulting in a better switching capacity. Thus, with the use of flat spiral petal contacts having a diameter of approximately 90 mm, short-circuit currents of up to about 130 kA can be switched. Independent of the diameter of the spiral petal contacts, it is advantageous to arrange a disc-shaped vapor seal(baffle) between the movable contact piece and the associated current-conducting bolt. This seal may be made for example of a chromium-nickel steel, and can be used, in vacuum switching, chambers having a small switching capacity, for the mechanical reinforcement of the movable spiral petal contact having reduced thickness.

The new construction of the vacuum switching chamber also enables an immediate binding of the stationary contact piece to the associated plate-type current terminal, as well as, for the movable contact piece, the use of a terminal bolt having a large diameter, ensuring an optimal heat dissipation. The compact overall design renders superfluous a special routing of the terminal bolt for the movable contact piece, as has previously been standard in vacuum switching tubes for power switches with the use of a plastic bushing. This enables a higher thermal loading of the vacuum switching chamber.

In addition, the new design of the vacuum switching chamber makes it possible to construct all the individual parts (except for the annular insulator) in self-centering fashion, so that all the individual parts can be soldered to one another in a single work pass (sealing soldering) without the use of expensive solder molds. For this purpose, it is advantageous for the stationary contact piece to be connected with the plate-type current terminal via a short centering support, and for the movable contact piece to be connected in centered fashion with the associated plate-type current terminal via a contact bolt.

The shape of the tubular part surrounding the two contact pieces, in particular the flat spiral petal contacts, depends on the switching capacity. Given a small switching capacity of approximately 40 to 60 kA, this part can be fashioned as a hollow cylinder. Given a larger switching capacity, i.e, given larger contact diameters, it is advantageous for the tube-shaped part to be provided with a conical taper at the end facing the annular insulator. This enables the use of an insulator and of a bellows having a diameter significantly smaller than that of the spiral petal contacts. Independent of the shaping of the tube-shaped part, which is may be made of copper, it is advantageous to provide this part—on the inner wall, in the area of the switching path—with a lining (coating) that is arc-resistant, for example using sheet metal parts made of a chromium-copper compound material, or using a galvanic coating with chromium.

DETAILED DESCRIPTION

Figure 1:
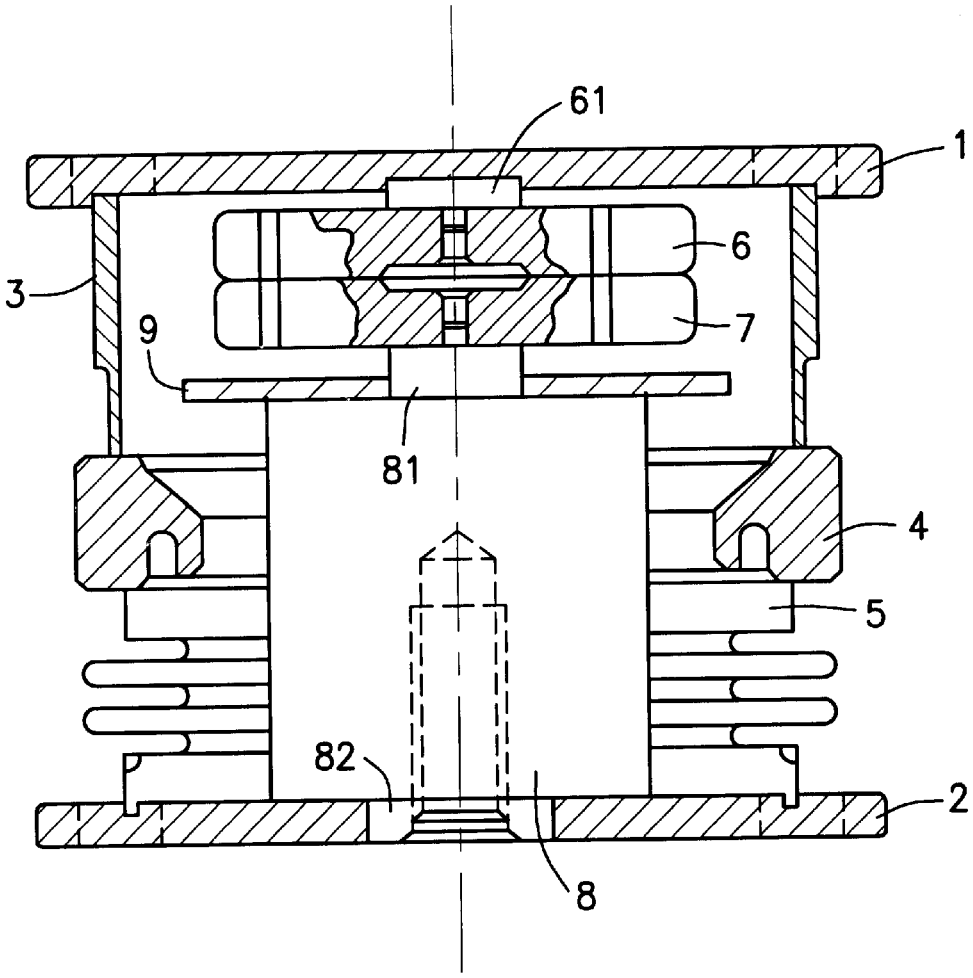
FIG. 1 shows a switching chamber having a tube-shaped part fashioned as a hollow cylinder, according to an example embodiment of the present invention.

In the vacuum switching chamber shown in FIG. 1, the housing is made of an upper metallic plate 1 made of copper, which functions as a current terminal, a hollow cylindrical wall part 3 made of copper and butt-soldered to plate 1, an annular insulator 4, a bellows 5 arranged coaxially to annular insulator 4, and a lower metallic plate 2 made of copper, also fashioned as a current terminal. In this context, the annular insulator is fashioned in the same way as the insulator described in German Patent No. 44 22 316, i.e., having an approximately square cross-section, and having a beveling and an undercutting. Inside the housing there are arranged a stationary flat spiral petal contact 6 and a movable flat spiral petal contact 7. Spiral petal contact 6 is connected with plate 1 via a short centering support 61 that engages in, a centering bore in the spiral petal contact. Spiral petal contact 7 is seated on a centering projection 81 of a current supply bolt 8, said projection effecting a restriction of the current flow. This bolt is set at its one end into plate 2, which functions as a current terminal, by means of a centering projection 82. Between movable spiral petal contact 7 and current supply bolt 8, another vapor seal 9 is provided in the form of a flat disc made of a mechanically solid material, such as for example chromium-nickel steel. This vapor seal 9 serves to shield annular insulator 4 from metal particles of spiral petal contacts 6 and 7 that are released during the switching process.

The design of the vacuum switching chamber according to FIG. 1 is selected such that all the individual parts can be soldered to one another in the context of a single soldering process. The degassing openings that are used for this purpose can be provided using means conventional in the region of the joint between annular insulator 4 and hollow cylindrical wall part 3.

Figure 2:
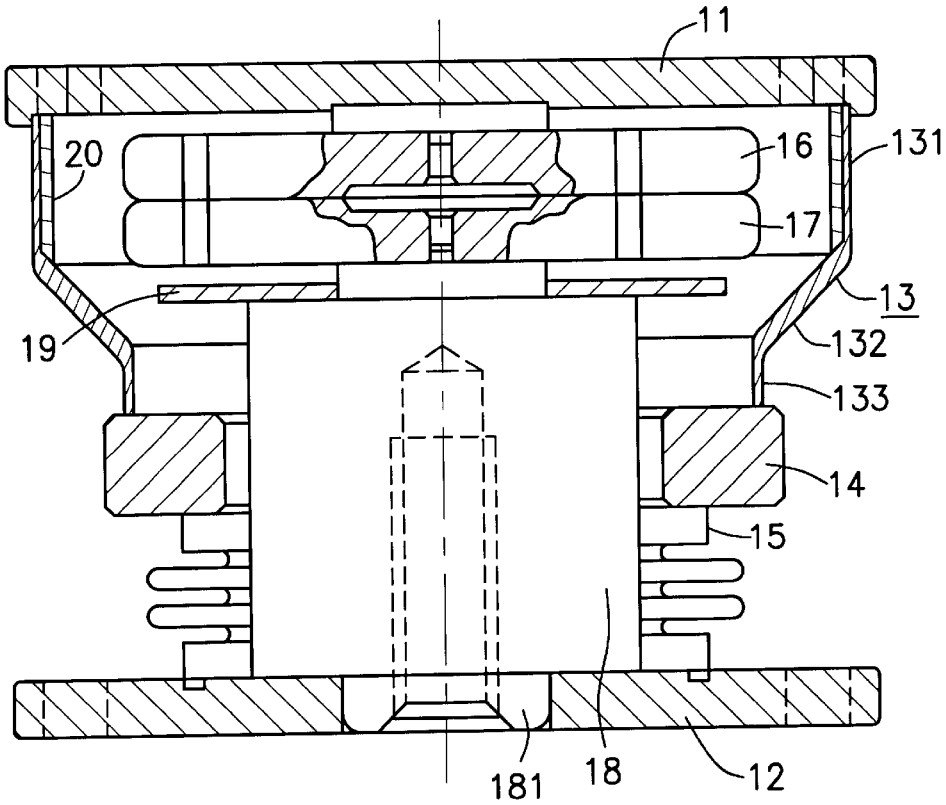
FIG. 2 shows a vacuum switching chamber having a tube-shaped part that has a partial conical taper, according to an example embodiment of the present invention.

With the allocation of plates 11 and 12, both functioning as current terminals, to annular insulator 14 and to bellows 15, and with the arrangement of stationary spiral petal contact 16 and of movable spiral petal contact 17, as well as of current supply bolt 18, with centering projection 181 and with vapor seal 19, the vacuum switching chamber shown in FIG. 2 generally corresponds to the design of the vacuum switching chamber according to FIG. 1. However, the vacuum switching chamber shown in FIG. 2 is provided for the highest switching powers, and thus has flat spiral petal contacts 16 and 17 having relatively large diameters. The shape of tube-shaped wall part 13, which radially limits the actual switching chamber, is matched thereto. For this purpose, tube-shaped wall part 13 has a cylindrical wall area 131 at the height of spiral petal contacts 16 and 17, and then goes over, via a conical tapering 132, into a cylindrical projection 133, via which wall part 13 is soldered with annular insulator 14 in the manner of a cutting soldering. Moreover, tube-shaped wall part 13 is provided, in cylindrical area 131, with an arc-resistant liner 20 that protects cylindrical area 131 against burning through. Since in this construction of the vacuum switching chamber annular insulator 14 is sufficiently protected, by vapor seal 19 and conical taper 132 of tube-shaped wall part 13, against depositing of metal vapor particles, the annular insulator is fashioned with a rectangular cross-section, differing from the specific embodiment of insulator 4 used in FIG. 1.

Figure 3:
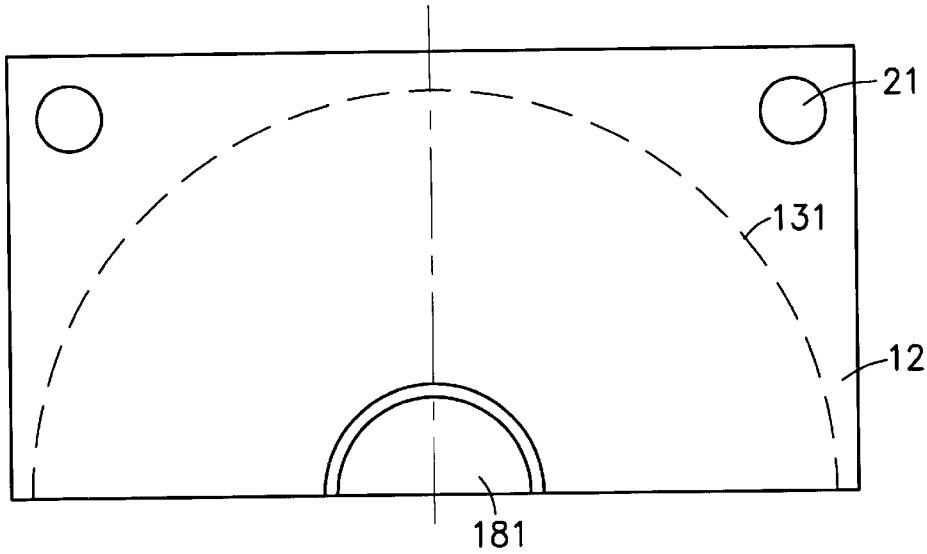
FIG. 3 shows a plate-type current terminal, in a top view according to an example embodiment of the present invention.

FIG. 3 shows a top view of plate 12—functioning as a current terminal—of the vacuum switching chamber according to FIG. 2. Due to a rectangular or square shaping of plate 12 and also of upper plate 11, sufficient space remains for bored holes 21, which are used to fasten the current terminals to corresponding parts of an associated switching device.

What is claimed is:

1. A vacuum switching chamber, comprising:

a stationary contact piece;

a movable contact piece axially movable relative to the stationary contact piece; and a housing including a first cap-type metal part, a second cap-type metal part and a bellows, a respective current terminal being allocated to each of the stationary contact piece and the movable contact piece, the first cap-type metal part and the second cap-type metal part being connected using an annular insulator, the first cap-type metal part surrounding the stationary contact piece and the movable contact piece, each respective current terminal being formed as a plate and forming a base of a Respective one of the first cap-type metal part and the second cap-type metal part, the bellows forming a wall area of the second cap-type metal part allocated to the movable contact piece, a tube-shaped part forming a wall area of the second cap-type metal part, the tube-shaped part having an end face, the end face of the tube-shaped part being butt-soldered with the current terminal allocated to the stationary contact piece.

2. The vacuum switching chamber according to claim 1, wherein each of the stationary contact piece and the movable contact piece is formed as a spiral petal contact.

3. The vacuum switching chamber according to claim 2, wherein each spiral petal contact is flat.

4. The vacuum switching chamber according to claim 1, wherein the stationary contact piece is connected to the respective current terminal allocated thereto via a centering connection piece.

5. The vacuum switching chamber according to claim 1, wherein the movable contact piece is connected to the current terminal allocated thereto in centered fashion via a contact bolt.

6. The vacuum switching chamber according to claim 1, wherein the tube-shaped part has a conical taper at an end facing the annular insulator.

7. The vacuum switching chamber according to claim 1, wherein the tube-shaped part includes an arc-resistant lining.

8. The vacuum switching chamber according to claim 7, wherein the arc-resistant lining is composed of a chromium-copper compound material.

9. The vacuum switching chamber according to claim 5, further comprising:

a disc-shaped vapor seal arranged between the movable contact piece and the contact bolt.

10. A vacuum switching chamber, comprising:

a stationary contact piece;

a movable contact piece axially movable relative to the stationary contact piece; and a housing including a first cap-type metal part, a second cap-type metal part and a bellows, a respective current terminal being allocated to each of the stationary contact piece and the movable contact piece, the first cap-type metal part and the second cap-type metal part being connected using an annular insulator, the first cap-type metal part surrounding the stationary contact piece and the movable contact piece, each respective current terminal being formed as a plate and forming a base of a respective one of the first cap-type metal part and the second cap-type metal part and forming a boundary wall of the vacuum switching chamber, the bellows forming a wall area of the second cap-type metal part allocated to the movable contact piece, a tube-shaped part forming a wall area of the second cap-type metal part, the tube-shaped part having an end face, the end face of the tube-shaped part being butt-soldered with the current terminal allocated to the stationary contact piece.

* * * * *